US008157606B2

(12) United States Patent
Tsai et al.

(10) Patent No.: US 8,157,606 B2
(45) Date of Patent: Apr. 17, 2012

(54) FABRICATING METHOD OF ELECTRON-EMITTING DEVICE

(75) Inventors: Chih-Hao Tsai, Changhua County (TW); Kuan-Jung Chen, Taipei County (TW); Fu-Ming Pan, Hsinchu County (TW); Chi-Neng Mo, Taoyuan County (TW); Kuo-Chung Lo, Tainan (TW); Mei-Tsao Chiang, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 174 days.

(21) Appl. No.: 12/500,610

(22) Filed: Jul. 10, 2009

(65) Prior Publication Data

US 2010/0216366 A1 Aug. 26, 2010

(30) Foreign Application Priority Data

Feb. 20, 2009 (TW) ..... 98105422 A

(51) Int. Cl.
*H01J 9/02* (2006.01)

(52) U.S. Cl. ..... 445/35

(58) Field of Classification Search ..... 445/35
See application file for complete search history.

(56) References Cited

U.S. PATENT DOCUMENTS

| | | | | |
|---|---|---|---|---|
| 5,591,061 | A | 1/1997 | Ikeda et al. | |
| 6,113,448 | A | 9/2000 | Kobayashi et al. | |
| 6,309,691 | B1 | 10/2001 | Hasegawa | |
| 6,344,711 | B1 | 2/2002 | Ohnishi et al. | |
| 6,621,475 | B1 | 9/2003 | Yamaguchi et al. | |
| 6,656,007 | B2 | 12/2003 | Fushimi et al. | |
| 6,762,541 | B1 | 7/2004 | Yamamoto et al. | |
| 2002/0090877 | A1 * | 7/2002 | Minami et al. | 445/6 |
| 2008/0227360 | A1 * | 9/2008 | Liu et al. | 445/46 |
| 2009/0022881 | A1 | 1/2009 | Tsai et al. | |

FOREIGN PATENT DOCUMENTS

| | | |
|---|---|---|
| CN | 1349241 | 5/2002 |
| CN | 101051587 | 10/2007 |
| TW | I238024 | 8/2005 |

OTHER PUBLICATIONS

"First Office Action of China Counterpart Application", issued on Oct. 21, 2011, p. 1-p. 5, in which the listed references were cited.

* cited by examiner

*Primary Examiner* — Anne Hines

(74) *Attorney, Agent, or Firm* — Jianq Chyun IP Office

(57) ABSTRACT

A fabricating method of an electron-emitting device is provided. The fabricating method of the electron-emitting device includes at least following procedures. Firstly, a substrate is provided. Next, a first electrode and a second electrode are formed on the substrate. Afterward, a conductive layer covering the first electrode and the second electrode is formed on the substrate. Then, a first conductive layer, a second conductive layer and a gap are formed by patterning the conductive layer. The gap is disposed between the first conductive layer and the second conductive layer. After that, a plasma process is performed at the first conductive layer and second conductive layer.

10 Claims, 4 Drawing Sheets

FABRICATING METHOD OF ELECTRON-EMITTING DEVICE

CROSS-REFERENCE TO RELATED APPLICATION

This application claims the priority benefit of Taiwan application serial no. 98105422, filed Feb. 20, 2009. The entirety of the above-mentioned patent application is hereby incorporated by reference herein and made a part of specification.

BACKGROUND OF THE INVENTION

1. Field of the Invention

The present invention relates to a fabricating method of an electron source device. More particularly, the present invention relates to a fabricating method of an electron-emitting device.

2. Description of Related Art

A Field Emission Display (FED) that is analogous to a conventional Cathode Ray Tube (CRT) display is a flat panel display technology. The principle of an operation of the FED is briefed as follows. First, with an induction of electric field, a plurality of electron source devices emits electrons from a cathode. Next, electrons are attracted and speeded up by an anode to bombard a phosphor on a surface of the anode so as to emit fluorescence light. After that, the fluorescence passes through the anode and emits from the back side of the anode. Thereafter, the back side of the anode which is on a front side of display panel can show an image.

According to different modes of electron emission, the electron source devices can be classified into a spindt, a Surface Conduction electron-emitting Device (SED), a Carbon Nanotube (CNT), a Ballistic Electron Surface emitting Display (BSD), and so on.

FIG. 1 illustrates a cross-section of a conventional electron-emitting device. Referring to FIG. 1, an electron-emitting device 100 includes a substrate 110, a first electrode 120*a*, a second electrode 120*b* and a conductive film 130, wherein the conductive film 130 has a gap G'. However, the width of the gap G' in the electron-emitting device 100 affects the relationship between a cathode voltage and an emitting current. The following description interprets the relationship among the cathode voltage, the emitting current and the gap G' width.

FIG. 2 illustrates a curve comparison showing the relationship of the cathode voltage and the emitting current of two kinds of conventional electron-emitting devices. Referring to FIG. 2, horizontal and vertical axes represent the cathode voltage and the emitting current, respectively. A curve 101 shows the characteristic curve about the relationship of the cathode voltage and the emitting current of the electron-emitting device having a gap G' width of 90 nanometers (nm). A curve 103 shows the characteristic curve about the relationship of the cathode voltage and the emitting current of the electron-emitting device having the gap G' width of 30 nm.

As shown in FIG. 2, the emitting current in the curve 103 is greater than the emitting current in the curve 101 under the same cathode voltage. That is, compared with the electron-emitting device having the gap G' width of 90 nm, the electron-emitting device having the gap G' width of 30 nm can adopt a lower cathode voltage to generate the emitting current. Furthermore, the component characteristic of the electron-emitting device having the gap G' width of 30 nm is better than the component characteristic of the electron-emitting device having the gap G' width of 90 nm. Thus, a FED technique is taken up with the development getting a smaller gap width in the electron-emitting device.

However, when the gap G' width is in a sub-micrometer scale, electrons can not be emitted from the surface of the conductive film 130 by a quantum tunnel effect under an enforced electric field. Thus, an activation process should be done for reducing the gap G' into a nanometer scale, wherein the better gap G' width is smaller than 5 nm. In addition, when the gap G' width is smaller, the electron-emitting device 100 has the better component characteristic. However, it is a precise but difficult to be controlled process for reducing the gap G' from the sub-micrometer scale into the nanometer scale.

SUMMARY OF THE INVENTION

The present invention provides a fabricating method of an electron-emitting device. The fabricating method can simplify a process of the electron-emitting device so as to fabricate the electron-emitting device having a good component characteristic.

The present invention provides the fabricating method of the electron-emitting device. The fabricating method can improve a yield so as to fabricate the electron-emitting device having a high electron emissivity.

The fabricating method of the electron-emitting device is provided in the present invention. First, a substrate is provided. Next, a first electrode and a second electrode are formed on the substrate. Then, a conductive layer is formed on the substrate, wherein the conductive layer covers the first electrode and the second electrode. Afterward, the conductive layer is patterned to form a first conductive layer, a second conductive layer, and a gap, wherein the gap is disposed between the first conductive layer and the second conductive layer. After that, a plasma process is performed on the first conductive layer and the second conductive layer.

In the embodiment of the foregoing fabricating method, a plasma utilized during the plasma process is selected from a group consisting of Argon, Hydrogen, Nitrogen, Oxygen, Ammonia, Ethylene ($C_2H_4$), Acetylene ($C_2H_2$), a fluorocarbon, and a combination thereof.

In the embodiment of the foregoing fabricating method, a gas pressure applied in the plasma process is greater than or equal to 100 Torr.

In the embodiment of the foregoing fabricating method, a gas pressure applied in the plasma process is smaller than or equal to 1 Torr.

In the embodiment of the foregoing fabricating method, a temperature applied in the plasma process is between 25 degrees Centigrade and 800 degrees centigrade.

In the embodiment of the foregoing fabricating method, a method of the patterning the conductive layer to form the gap comprises a photolithography process, a focused ion beam (FIB) process, or a palladium hydrogen embrittlement process.

In the embodiment of the foregoing fabricating method, a width of the gap is substantially between 5 and 100 nanometers (nm).

In the embodiment of the foregoing fabricating method, materials of the first electrode and the second electrode are selected from Nickel, Chromium, Gold, Molybdenum, Wolfram, Platinum, Titanium, Aluminum, Copper, Palladium, Tantalum, Silver, and an alloy thereof.

In the embodiment of the foregoing fabricating method, a material of the conductive layer is selected from Carbon, Silicon, Germanium, Palladium, Ruthenium, Silver, Gold, Titanium, Indium, Copper, Chromium, Iron, Zinc, Stannum, Tantalum, Wolfram, Iridium, Magnesium, Hafnium, Lead, a metal oxides thereof, a metal borides thereof, a metal carbides thereof, a metal nitrides thereof, a metal complex oxides thereof, and a metal complex alloy thereof.

In the embodiment of the foregoing fabricating method, a material of the substrate includes silicon, quartz, or glass.

In the embodiment of the foregoing fabricating method, the fabricating method further comprises that an adhesive layer is formed, wherein the first electrode and the second electrode are formed on the adhesive layer.

In the embodiment of the foregoing fabricating method, a material of the adhesive layer is selected from Titanium, titanium nitride, Tantalum, tantalum nitride, and a combination thereof Accordingly, the fabricating method of the electron-emitting device provided in the present invention adopts the plasma process to enhance the component characteristic of the electron-emitting device. Besides, the fabricating method of the electron-emitting device according to the present invention can reduce complexity of the process so as to reduce cost. In addition, the fabricating method can fabricate the electron-emitting device in a large area, and further enhance production capacity.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
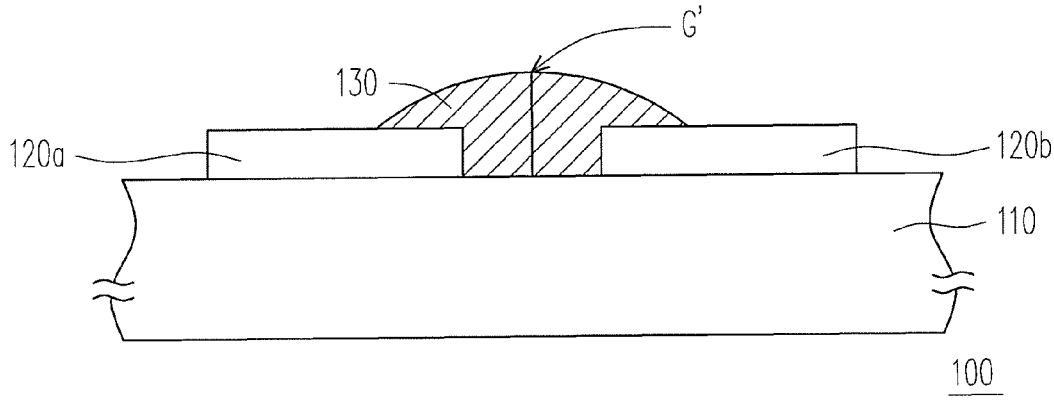
FIG. 1 (PRIOR ART)
FIG. 1 illustrates a cross-section of a conventional electron-emitting device.
Figure 2:
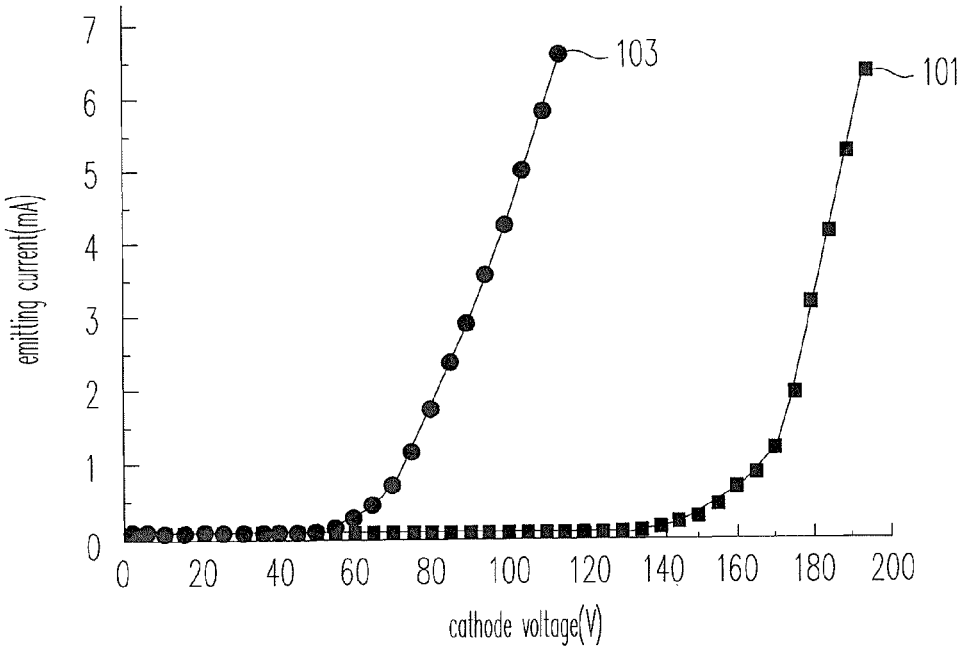
FIG. 2 (PRIOR ART)
FIG. 2 illustrates a curve comparison showing the relationship of the cathode voltage and the emitting current of two kinds of conventional electron-emitting devices.

Reference will now be made in detail to the present embodiments of the invention, examples of which are illustrated in the accompanying drawings. Wherever possible, the same reference numbers are used in the drawings and the description to refer to the same or like parts.

FIG. 3A-3E illustrate a cross-section flow of a fabricating method of an electron-emitting device according to one embodiment. Then, the fabricating method of the electron-emitting device can be understood with the references FIG. 3A-3E.

Figure 3A:
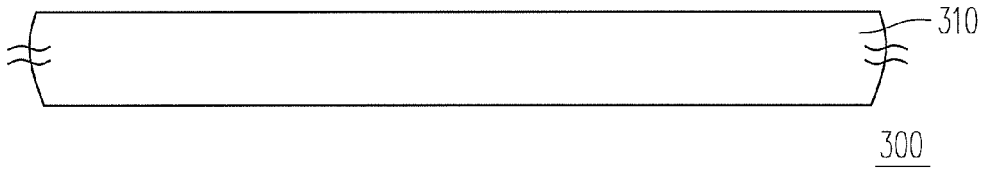
FIG. 3A-3E illustrate a cross-section flow of a fabricating method of an electron-emitting device according to one embodiment.

Referring to FIG. 3A at first, a substrate 310 is provided. A material of the substrate 310 can be silicon or glass in the embodiment.

Figure 3B:
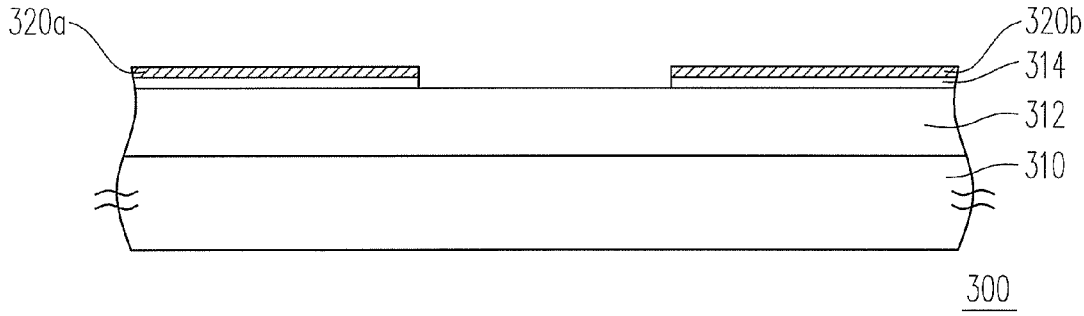

Next, referring to FIG. 3B, a first electrode 320*a* and a second electrode 320*b* are formed on the substrate 310. In the embodiment, materials of the first electrode 320*a* and the second electrode 320*b* are selected from, for example, Nickel, Chromium, Gold, Molybdenum, Wolfram, Platinum, Titanium, Aluminum, Copper, Palladium, Tantalum, Silver, and an alloy thereof. Besides, one example of formation processes of the first electrode 320*a* and the second electrode 320*b* is an electrode thin film deposited first by a chemical/physical vapor deposition. Later, the first electrode 320*a* and the second electrode 320*b* are formed by patterning in a photolithography etching process. The physical vapor deposition is, for instance, ion sputtering, electron gun evaporation, plasma assisted chemical vapor deposition, or a well-known process. The photolithography etching process is also well-known and not given details here.

In the embodiment, an insulating layer 312 is formed on the substrate 310 before the formation processes of the first electrode 320*a* and the second electrode 320*b*. In other words, if the substrate 310 is a conductive substrate, the insulating layer 312 can be applied for insulation and keeping off a leakage current induced between the substrate 310 and the first/second electrode 320*a*/320*b*. One example of a material of the insulating layer 312 is silicon dioxide or aluminum oxide. More precisely, when the substrate 310 adopts silicon, a surface of the substrate 310 is oxidized by a high temperature furnace tube oxidation method. The formed silicon dioxide can be the insulating layer 312. Surely, in the other embodiment the substrate 310 can be an insulating substrate for providing insulation from the substrate 310 and the first/second electrode 320*a*/320*b*.

Especially, after the insulating layer 312 is formed in the embodiment, an adhesive layer 314 can be formed on the substrate 310 such that the first electrode 320*a* and the second electrode 320*b* can be formed on the adhesive layer 314. A material of the adhesive layer 314 is selected from, for instance, Titanium, titanium nitride, Tantalum, tantalum nitride, and a combination thereof. Accordingly, adherences between the insulating layer 312 and the first electrode 320*a* or the second electrode 320*b* can be strengthened.

Figure 3C:
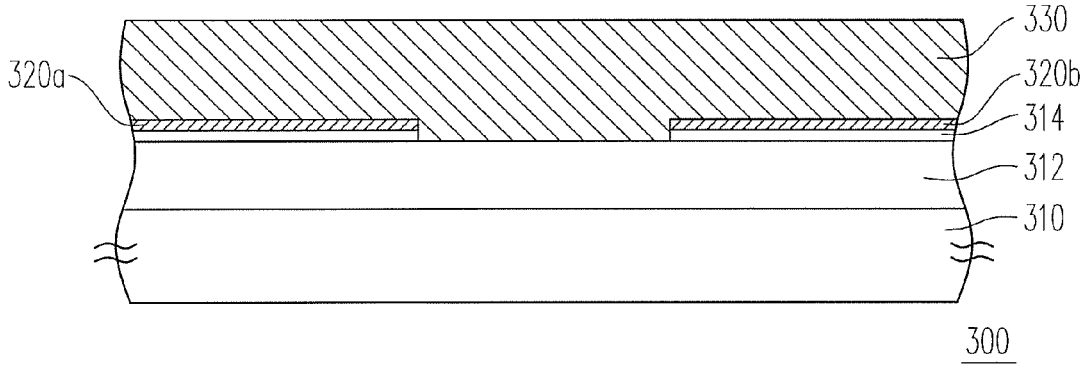

Afterward, referring to FIG. 3C, a conductive layer 330 is formed on the substrate 310 and covering the first electrode 320*a* and the second electrode 320*b*. In the embodiment, for example, the conductive layer 330 can be formed by a conductive thin film deposited by a chemical/physical vapor deposition. One example of the physical vapor deposition is ion sputtering, electron gun evaporation, plasma assisted chemical vapor deposition, or a well-known process.

Accordingly, a material of the conductive layer 330 is selected from, for instance, Carbon, Silicon, Germanium, Palladium, Ruthenium, Silver, Gold, Titanium, Indium, Copper, Chromium, Iron, Zinc, Stannum, Tantalum, Wolfram, Iridium, Magnesium, Hafnium, Lead, a metal oxides thereof, a metal borides thereof, a metal carbides thereof, a metal nitrides thereof, a metal complex oxides thereof, and a metal complex alloy thereof.

Figure 3D:
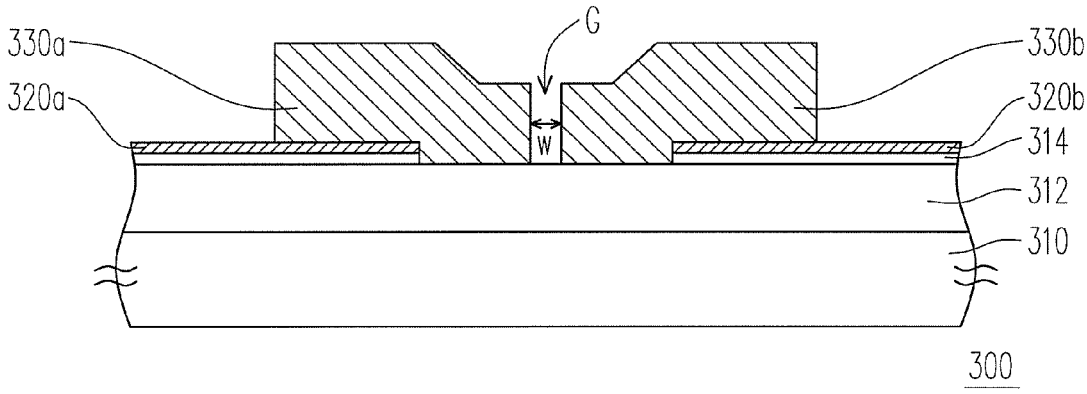

After that, referring to FIG. 3D, a first conductive layer 330*a*, a second conductive layer 330*b*, and a gap G are formed by patterning the conductive layer 330, wherein the gap G is disposed between the first conductive layer 330*a* and the second conductive layer 330*b*. In the embodiment, formation processes of the first conductive layer 330*a*, the second conductive layer 330*b* and the gap G are, for example, a photolithography process, a focused ion beam (FIB) process, or a palladium hydrogen embrittlement process.

Referring to FIG. 3D, it is understood that the first conductive layer 330*a* covers a part of the first electrode 320*a*, and the second conductive layer 330*b* covers a part of the second electrode 320*b*. It is deserved to be mentioned that a width W of the gap G disposed between the first electrode 320*a* and the second electrode 320*b* is substantially between 5 and 100 nanometers (nm), wherein the first electrode 320*a* and the second electrode 320*b* can be an emitter and a gate, respectively. However, the width W of the gap G may be controllable by conditions of process based on the foregoing photolithography process, focused ion beam process, or hydrogen embrittlement process.

Figure 3E:
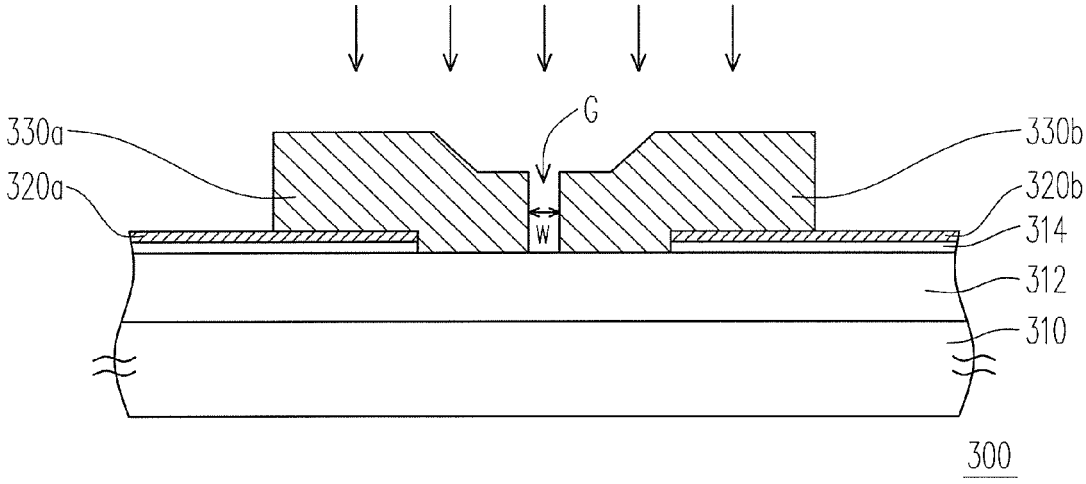

Subsequently, referring to FIG. 3E, the first conductive layer 330*a* and the second conductive layer 330*b* are proceeding with a plasma process, wherein the plasma process is, for example, a plasma surface modification process. In the embodiment, a temperature applied in the plasma process is between 25 degrees Centigrade and 800 degrees Centigrade. In addition, selective plasma used in the plasma process is selected from group consisting of Argon, Hydrogen, Nitrogen, Oxygen, Ammonia, Ethylene ($C_2H_4$), Acetylene ($C_2H_2$), a fluorocarbon, and a combination thereof.

More precisely, a plasma type adopted in the recited plasma process is, for instance, hot plasma under a pressure that is essential greater than or equals 100 Torr. The hot plasma is so-call an Equilibrium Plasma. Besides, one example of a proceeding of the plasma process is that the emitter (the first conductive layer 330*a*) and the gate (the second conductive layer 330*b*) are proceeding with an ion bombardment process. Meanwhile, a portion of plasma molecules reacts with the emitter/gate and form compounds in surfaces of the emitter and the gate. The compounds can reduce a work function of an electron-emitting device 300.

Likewise, in the other embodiment, the plasma type applied in the recited plasma process is, for example, under the pressure that is essential less than or equals 1 Torr. Meanwhile, the plasma type is a low temperature plasma, or so-called a Non-Equilibrium Plasma. So far, the electron-emitting device 300 is almost complete in the embodiment.

Figure 4:
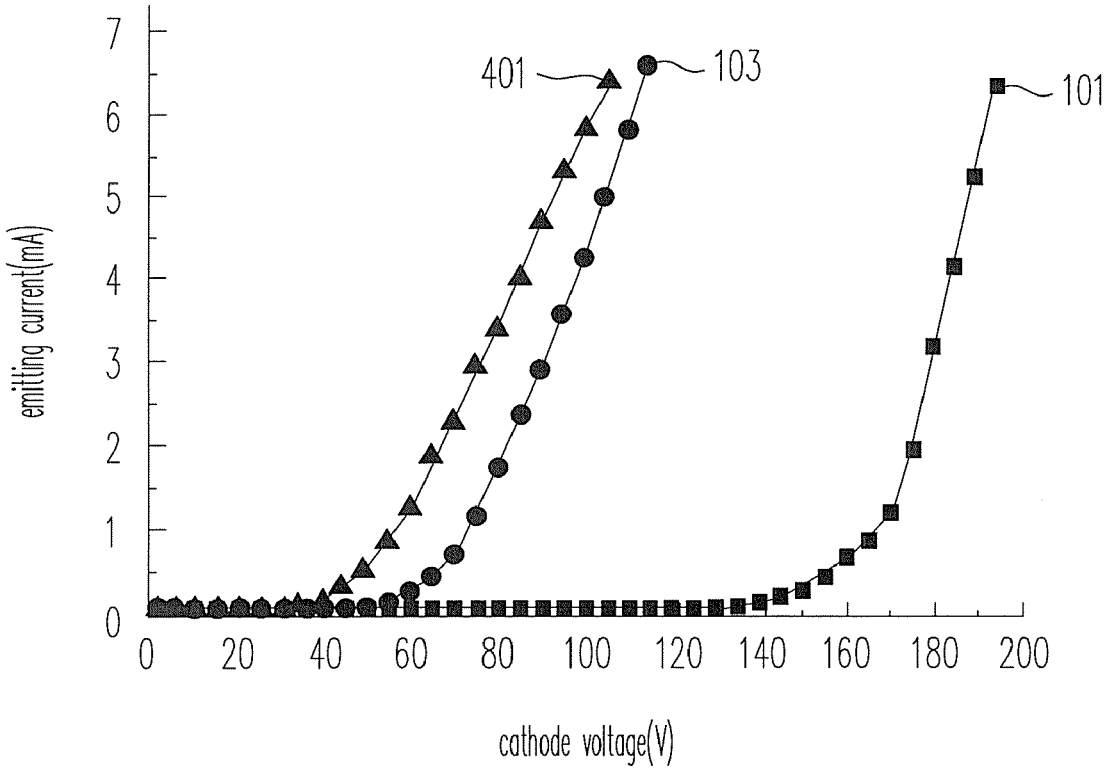
FIG. 4 illustrates a curve comparison diagram for comparing a cathode voltage and an emitting current of two conventional electron-emitting devices and those of the electron-emitting device according to the embodiment.

FIG. 4 illustrates a curve comparison diagram for comparing a cathode voltage and an emitting current of two conventional electron-emitting devices and those of the electron-emitting device according to the embodiment. Referring to FIG. 4, horizontal and vertical axes represent the cathode voltage and the emitting current, respectively. A curve 401 shows the characteristic curve drawn by the cathode voltage and the emitting current of the embodiment of the electron-emitting device. Curves 101 and 103 show the characteristic curves drawn by the cathode voltage and the emitting current of two conventional electron-emitting devices.

As the foregoing, the gap width in the embodiment of the electron-emitting device is substantially 90 nm, and its corresponding characteristic curve is the curve 401. The gap width in one conventional electron-emitting device is essentially 90 nm, and its corresponding characteristic curve is the curve 101. The gap width in the other conventional electron-emitting device is essential 30 nm, and its corresponding characteristic curve is the curve 103.

More precisely, as shown by the curves 401 and 101 in FIG. 4, the emitting current in the curve 401 is greater than that in the curve 101 under the same cathode voltage, wherein the gap widths of the electron-emitting devices corresponding to the curves 401 and 101 are both substantially 90 nm. Because the gap in the embodiment of the electron-emitting device is proceeding with the plasma process, the component characteristic of the embodiment of the electron-emitting device is better than the component characteristic of the conventional electron-emitting device having the gap width of 90 nm.

Referring to the curves 401 and 103, the emitting current in the curve 401 is greater than that in the curve 103 under the same cathode voltage, wherein the gap widths of the electron-emitting devices corresponding to the curves 401 and 103 are substantially 90 and 30 nm, respectively. Because the gap in the embodiment of the electron-emitting device is proceeding with the plasma process, the component characteristic of the embodiment of the electron-emitting device is better than the component characteristic of the conventional electron-emitting device having the gap width of 30 nm. In other words, the component characteristic of the electron-emitting device can be enhanced by a large extent without narrowing the gap width (e.g. maintain an original gap width) in the plasma process adopted in the embodiment.

As the foregoing, the electron-emitting device can induce a quantum tunnel effect by the plasma process applied in the embodiment, rather by a difficult process for gap width narrowing. Besides, the electron-emitting device can obtain a larger emitting current under a lower cathode voltage. Namely, the electron-emitting device can enhance its component characteristic by the gap, the first conductive layer, and the second conductive layer.

In summary, the electron-emitting device according to the present invention has advantages.

(1) The electron-emitting device accomplished by the fabricating method of the electron-emitting device according to the present invention is proceeding with the plasma process, changes a characteristic of its surface. Furthermore, the component characteristic of the electron-emitting device has a great improvement. In addition, a gap width less than 5 nm in a traditional process also can be achieved using the fabricating method of the electron-emitting device according to the present invention, so as to enhance the component characteristic of the electron-emitting device.

(2) The fabricating method of the electron-emitting device according to the present invention can use the mature chemical/physical vapor deposition and the photolithography etching process to fabricate the first electrode, the second electrode, and the conductive layer. As well as the gap, the first conductive layer, and the second conductive layer 330*b* can be fabricated by the mature photolithography process, the focused ion beam process, or the palladium hydrogenation process. Thus, a precision of the fabricating method of the present invention is better, and further a yield can be improved.

(3) Processes and methods of the electron-emitting device achieved by the fabricating method of the electron-emitting device according to the present invention are simple and of low cost.

(4) The fabricating method of the electron-emitting device according to the present invention can easily fabricate the electron-emitting device in a large area, and further enhance production capacity.

Although the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A fabricating method of an electron-emitting device, comprising:

providing a substrate;

forming a first electrode and a second electrode on the substrate;

forming a conductive layer on the substrate, wherein the conductive layer covers the first electrode and the second electrode;

patterning the conductive layer to form a first conductive layer, a second conductive layer, and a gap, wherein the gap is disposed between the first conductive layer and the second conductive layer; and performing a plasma process on the first conductive layer and the second conductive layer;

wherein a plasma utilized during the plasma process is selected from the group consisting of Argon, Hydrogen, Nitrogen, Oxygen, Ammonia, Ethylene (C2H4), Acetylene (C2H2), a fluorocarbon, and a combination thereof, and a gas pressure applied in the plasma process is greater than or equal to 100 Torr.

2. The fabricating method of the electron-emitting device as claimed in claim 1, wherein a gas pressure applied in the plasma process is smaller than or equal to 1 Torr.

3. The fabricating method of the electron-emitting device as claimed in claim 1, wherein a temperature applied in the plasma process is between 25 degrees centigrade and 800 degrees centigrade.

4. The fabricating method of the electron-emitting device as claimed in claim 1, wherein a method of patterning the conductive layer to form the gap comprises a photolithography process, a focused ion beam process, or a metal hydrogen embrittlement process.

5. The fabricating method of the electron-emitting device as claimed in claim 1, wherein a width of the gap is between 5 and 100 nanometers.

6. The fabricating method of the electron-emitting device as claimed in claim 1, wherein materials of the first electrode and the second electrode are selected from Nickel, Chromium, Gold, Molybdenum, Wolfram, Platinum, Titanium, Aluminum, Copper, Palladium, Tantalum, Silver, and an alloy thereof.

7. The fabricating method of the electron-emitting device as claimed in claim 1, wherein a material of the conductive layer is selected from Carbon, Silicon, Germanium, Palladium, Ruthenium, Silver, Gold, Titanium, Indium, Copper, Chromium, lion, Zinc, Stannum, Tantalum, Wolfram, Iridium, Magnesium, Hafnium, Lead, a metal oxides thereof, a metal borides thereof, a metal carbides thereof, a metal nitrides thereof, a metal complex oxides thereof, and a metal complex alloy thereof.

8. The fabricating method of the electron-emitting device as claimed in claim 1, wherein a material of the substrate comprises silicon, quartz, or glass.

9. The fabricating method of the electron-emitting device as claimed in claim 1, further comprises:

forming an adhesive layer, wherein the first electrode and the second electrode are formed on the adhesive layer.

10. The fabricating method of the electron-emitting device as claimed in claim 9, wherein a material of the adhesive layer is selected from Titanium, titanium nitride, Tantalum, tantalum nitride, and a combination thereof.

* * * * *